US007728499B2

(12) United States Patent
Singh et al.

(10) Patent No.: US 7,728,499 B2
(45) Date of Patent: Jun. 1, 2010

(54) THERMAL MANAGEMENT OF HIGH INTENSITY DISCHARGE LAMPS, COATINGS AND METHODS

(75) Inventors: Preeti Singh, Karnataka (IN); Mohamed Rahmane, Clifton Park, NY (US); Venkat Subramaniam Venkataramani, Clifton Park, NY (US); Balasubramaniam Vaidhyanathan, Leicestershire (GB); Gregory Michael Gratson, Ballston Lake, NY (US); Sheela Kollali Ramasesha, Karnataka (IN); Mohandas Nayak, Karnataka (IN)

(73) Assignee: General Electric Company, Schenectady, NY (US)

( * ) Notice: Subject to any disclaimer, the term of this patent is extended or adjusted under 35 U.S.C. 154(b) by 229 days.

(21) Appl. No.: 11/946,595

(22) Filed: Nov. 28, 2007

(65) Prior Publication Data

US 2009/0134759 A1 May 28, 2009

(51) Int. Cl.
*H01J 1/62* (2006.01)

(52) U.S. Cl. ..... 313/489; 313/635

(58) Field of Classification Search ..... 313/489, 313/635

See application file for complete search history.

(56) References Cited

U.S. PATENT DOCUMENTS

| | | | | |
|---|---|---|---|---|
| 3,374,377 | A | 3/1968 | Cook et al. | |
| 4,281,267 | A | 7/1981 | Johnson | |
| 5,552,671 | A | 9/1996 | Parham et al. | |
| 5,998,915 | A | 12/1999 | Scholz et al. | |
| 6,404,129 | B1 | 6/2002 | Hendricx et al. | |
| 6,639,341 | B1 | 10/2003 | Sakai et al. | |
| 2004/0104678 | A1 * | 6/2004 | Bigio et al. | 313/635 |
| 2004/0108814 | A1 | 6/2004 | Tsuda et al. | |
| 2004/0174121 | A1 | 9/2004 | Tsuda et al. | |
| 2005/0007020 | A1 | 1/2005 | Tsuda et al. | |
| 2005/0116608 | A1 * | 6/2005 | Haacke et al. | 313/489 |
| 2006/0164016 | A1 | 7/2006 | Rintamaki et al. | |
| 2006/0164017 | A1 | 7/2006 | Rintamaki et al. | |
| 2006/0202627 | A1 | 9/2006 | Dudik et al. | |
| 2006/0255739 | A1 * | 11/2006 | Ritz et al. | 313/635 |
| 2007/0120458 | A1 | 5/2007 | Rahmane et al. | |
| 2007/0120492 | A1 | 5/2007 | Selezneva et al. | |
| 2007/0132153 | A1 | 6/2007 | Aiyer et al. | |

FOREIGN PATENT DOCUMENTS

| | | | |
|---|---|---|---|
| WO | WO 2004/051700 | A2 | 6/2004 |

* cited by examiner

*Primary Examiner*—Vip Patel
(74) *Attorney, Agent, or Firm*—GE Global Patent Operation; Peter T. DiMauro

(57) ABSTRACT

Ceramic HID lamps with improved thermal management having an adherent infrared reflective coating layer located on the outer surface of the vessel are described. They include a coating of a nonmetallic material proximate the first and second end portions of the vessel. Such coatings can minimize temperature gradients during lamp operation. Methods for preparing such lamps with improved thermal management are described as well.

21 Claims, 5 Drawing Sheets

A

B

C

THERMAL MANAGEMENT OF HIGH INTENSITY DISCHARGE LAMPS, COATINGS AND METHODS

BACKGROUND

The present disclosure generally relates to the management of thermal gradients in high-intensity discharge (HID) lamps. In particular, the present disclosure generally relates to coatings for ceramic HID lamps which enable the management of thermal gradients so as to achieve enhanced reliability for such lamps in various applications.

Within various industries including the automotive industry, HID lamps are beginning to replace conventional incandescent halogen lights as lights for headlamps. In a typical HID lamp, light is generated by means of an electric discharge that takes place between metal electrodes enclosed within an envelope sealed at both its ends. The main advantages of HID lamps are high lumen output, better efficiency and longer life. In operation, the lamp size is kept small enough for optical coupling purposes. Further, for automotive applications, the lamps are required to meet industry standards of fast starting, by delivering a major portion of steady state lumens shortly after the point at which they are turned on. The small lamp size and fast start requirements result in potential high thermal loading. These limitations can result in shortening the lamp life and also decreasing reliability of the lamp. To improve reliability, quartz which had been typically used in HID lamp envelopes is being replaced with ceramic material, such as polycrystalline alumina (PCA) and yttrium aluminum garnet (YAG). Ceramic arc-tubes can withstand higher temperatures, which results in higher dose vapor pressure enabling increased efficiency, better color, and higher performance and has increased physical strength and resistance to chemical corrosion, which contribute to a longer operating life.

HID lamps attain high operating temperatures because of the heat associated with the high intensity discharge. Discharge lamps typically produce light by ionizing a vapor fill material such as a mixture of rare gases, metal halides and mercury with an electric arc passing between two electrodes. The electrodes and the fill material are sealed within a translucent or transparent discharge vessel which maintains the pressure of the energized fill material and allows the emitted light to pass through it. The fill material, also known as a "dose," emits a desired spectral energy distribution in response to being excited by the electric arc. For example, halides provide spectral energy distributions that offer a broad choice of light properties, e.g. color temperatures, color renderings, and luminous efficiencies.

However, despite the advances which have been made in development of HID lamps, including the use of light-emitting ceramic envelopes therefor, there continues to be a need to improve both the performance and reliability of such lamps.

BRIEF SUMMARY OF THE INVENTION

One embodiment of the present disclosure is directed to a high intensity gas discharge lamp with improved thermal management, said lamp comprising: an elongated light-emitting discharge vessel having a wall formed of a ceramic material, said vessel having central portion enclosing an interior space, and first and second end portions; an ionizable dose within said interior space; first and second discharge electrodes positioned within the vessel proximate said first end portion and said second end portion, respectively;

wherein said lamp further comprises at least one adherent infrared reflective coating layer located on the outer surface of the vessel proximate the first and second end portions, said coating layer comprising a nonmetallic material; wherein a location and a thickness of said coating layer are each preselected to minimize temperature gradients in the vessel during lamp operation.

Another embodiment of the present disclosure is directed to a method for manufacturing a high intensity gas discharge lamp with improved thermal management, the method comprising: providing an elongated light-emitting discharge vessel having a wall formed of a ceramic material, said vessel having a central portion enclosing an interior space, and first and second end portions, said vessel configurable to enclose an ionizable dose within said interior space; coating said vessel on the outer surface thereof proximate its first and second end portions with at least one adherent infrared reflective coating layer including a nonmetallic material; wherein a location and a thickness of said coating layer are each preselected to minimize temperature gradients in the vessel during lamp operation.

Other features and advantages of this disclosure will be better appreciated from the following detailed description.

BRIEF DESCRIPTION OF THE DRAWINGS

The following detailed description is made with reference to the accompanying drawings, in which.

DETAILED DESCRIPTION OF THE EMBODIMENTS

Figure 1:
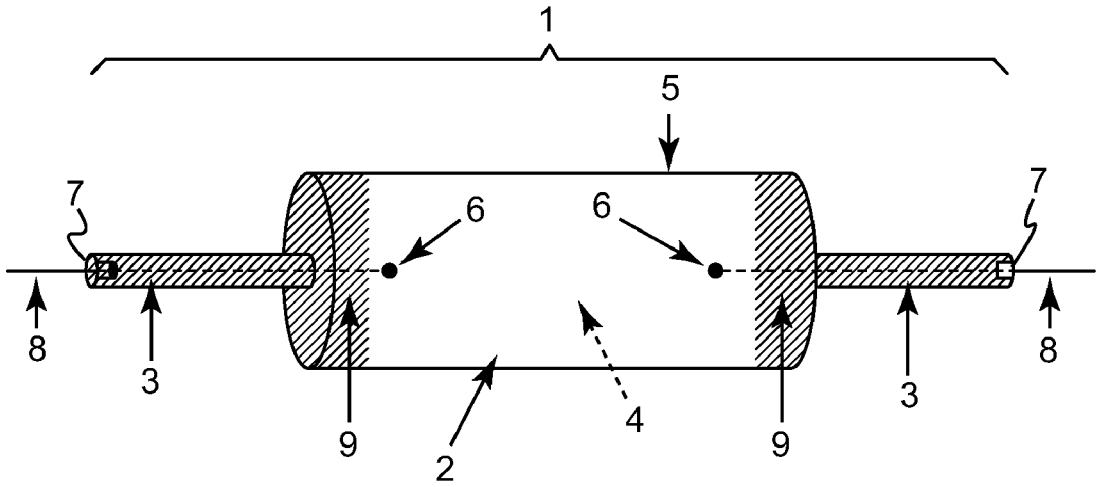
FIG. 1 is a schematic illustration of a ceramic HID lamp coated according to illustrative embodiments of the disclosure.

A typical ceramic discharge lamp according this disclosure includes an elongated ceramic discharge vessel containing a dose or a fill of an ionizable material. This discharge vessel has a central portion which defines an interior space, the central portion having a longer axis and a shorter axis. For a central portion with a cylindrical shape (for example), the longer axis would be parallel to the length of the cylinder and the shorter axis would be perpendicular to this length; but it is understood that the disclosure is not to be limited to merely a cylindrical central portion but can include any elongated shape, including ones with polygonal or any other cross section. Within the discharge vessel can be positioned at least two electrodes so as to energize the dose when an electric current is applied thereto. For vessels with a generally cylindrically shaped central portion, the central portion includes a substantially cylindrical wall and two spaced end walls connected at both ends of the cylindrical wall, the end walls lying generally perpendicular to the longer axis. Vessels according to this disclosure also include at least two end portions or "legs", extending from the two spaced end walls, and these leg portions each support at least one electrode at least partially therein. A typical ceramic discharge lamp according this disclosure can also include a ballast electrically connected to the lamp. As defined herein, a "vessel" includes both the central portion, and the at least two end portions.

According to typical methods of manufacturing ceramic discharge vessels, before the vessel is sealed, a composition including an ionizable dose is injected and sealed, under controlled atmosphere, in the body of the vessel. When power is supplied to the electrodes, an electric arc strikes between electrode tips within the vessel's body, creating a plasma discharge. General methods of manufacturing ceramic discharge lamps are known to skilled persons in the field, and include those taught in US Patent Publications 2007/0120458, 2006/164016, and 2007/120492, all of which are hereby incorporated by reference.

It has been found that, by virtue of the localized nature of discharge within the vessel, thermal gradients in the lamp during operation can cause cracking at the end portions of the lamp and/or at the central portion of the vessel, resulting in failure. Also, it has been found that cold areas of the lamp can serve as condensation points for the dose, which lowers the lamp efficiency. These and similar thermal gradients are one of the main causes for lamp failure through vessel cracking. It is also a limitation for lamp efficiency due to low cold spot temperature at the end portions of the lamp. The dose can condense in the coldest points in the lamp, so lamps require a larger dose amount in order to operate effectively. As the term is used herein "thermal gradients" refers to gradients anywhere in the vessel, and includes both azimuthal temperature gradients (that is, from top to bottom of the vessel, especially in the region at the center of arc discharge), and axial temperature gradients (that is, from the center of arc discharge to the end portions of the vessel, especially near electrodes).

It has been further found that in designing a ceramic HID lamp, consideration should be given to circumferential and axial tensile stresses that may develop on the outside part of the vessel during operation of the lamp. These stresses may result from significant temperature gradients within the vessel that result from heat flux from the discharge to the walls. In view of this issue, one design goal described herein is to have a lamp with decreased temperature gradients within the vessel as well as along its length. Another design goal is to limit stresses and temperature increases on the inside of the discharge vessel. Limitation of the stresses and temperature will reduce a possibility of creep deformation within the vessel.

Therefore, the present inventors have discovered that by managing the thermal profile of these lamps, both performance and reliability can be improved. In ceramic HID lamps, the center discharge location is hotter than the end terminals, appropriately called the cold spots. The lower temperature away from the discharge location is due to reasons such as thermal conductivity of the lamp, the distance from the discharge location and the heat loss by radiation. One way to manage this thermal gradient is to block heat loss from the cold spot (which can ordinarily be at a temperature of about 1200 K) while keeping the hot spot temperature below about 1500 K. The present disclosure applies infrared light (IR)-reflective coatings on at least the end portions of the lamp in order to prevent heat loss, which can increase the uniformity of the lamp thermal profile and increase the performance and efficiency. These coatings also can prevent lamp failure due to tube cracking occurring at the end portions, by retarding any sudden thermal cool down.

According to embodiments of the disclosure, a high intensity gas discharge lamp with improved thermal management comprises an elongated light-emitting discharge vessel having a wall formed of a ceramic material, with the vessel having a central portion enclosing an interior space, and first and second end portions. The interior space is generally a gas-tight discharge space. The ceramic material can be a polycrystalline alumina (PCA); or a highly dense, generally isotropic polycrystalline ceramic, such as yttrium-aluminum garnet (YAG), yttria, spinel, aluminum oxynitride or aluminum nitride; or a single crystal ceramic such as sapphire or single crystal YAG; or a translucent gas-tight aluminum oxide; or the like. Other ceramic materials are contemplated to be within the scope of the disclosure and it should not be construed as limited only to those named. Within the interior space of the vessel is contained an ionizable dose. Typically, an ionizable dose according to the disclosure comprises at least one selected from the group consisting of noble gas, halogen, rare earth element, mercury, thallium, indium, alkali metal element, and combinations and compounds thereof. Other components, such as transition metal halides, can also be present. An exemplary combination of these dose materials includes the use of an noble gas, a metal halide, and optionally, mercury. In such embodiments, the metal halide can be one or more metal iodides such as sodium iodide, scandium iodide, thallium iodide, dysprosium iodide, holmium iodide, neodymium iodide, aluminum iodide, iron iodide, zinc iodide, antimony iodide, manganese iodide, chromium iodide, gallium iodide, beryllium iodide, thulium iodide and titanium iodide. In other exemplary embodiments, the dose materials include Xe, Zn, and iodides of Zn, Na, Tl and Ce. However, the present disclosure is not intended to be limited only to these named dose materials.

As noted above, the vessel comprises end portions. Each end of the elongated vessel is plugged by a first end portion and a second end portion. As used herein, the term "end portion" is taken to be synonymous with "leg". In some embodiments, both legs are cylindrical. Legs can be ceramic but may be other materials such as molybdenum, or other refractory metals or their alloys, or combinations of ceramic and metal such as cermets. Extending from the legs are current conductors which can have portions made of tungsten, molybdenum, niobium and/or other materials as known in the art. See US 2005/0007020 A1, US 2004/0174121 A1, U.S. Pat. No. 5,998,915, US 2004/0108814 A1, U.S. Pat. No. 6,404,129 B1 and WO 2004/051700 A2, the contents of which are incorporated by reference. The legs and current conductors can be sealed in different manners, all as known in the art. As known in the art, a ceramic sealing compound can be used to seal the current conductors inside the legs. With the vessel, proximate the first and second end portions, are positioned discharge electrodes, as is conventional in the art. Typically, the current conductors are in electrical communication with the discharge electrodes within the interior portion of the vessel.

According to embodiments of the present disclosure, ceramic HID lamps further comprises at least one adherent infrared reflective coating layer located on the outer surface of the vessel proximate the first and second end portions. The coating layer comprises a nonmetallic material. The location and a thickness of the coating layer on the vessel's outer surface are each preselected so as to minimize temperature gradients in the vessel during lamp operation (e.g., during steady-state operation). For instance, one non-limiting example of a relevant temperature gradient in the vessel is the temperature difference between lamp hot spot temperature and lamp cold spot temperature during lamp operation. As used herein, the terms "lamp hot spot temperature" and "lamp cold spot temperature" refer to the highest temperature in the vessel adjacent the interior portion during lamp operation, and the lowest temperature in the vessel adjacent the interior portion during lamp operation, respectively.

In some embodiments, the infrared reflective coating layer on the vessel outer surface is of sufficient composition and durability such that it substantially does not undergo deterioration in infrared reflectance capability after thermal cycling to lamp operating temperature for the life the lamp. In other embodiments, the infrared reflective coating layer on the vessel outer surface is of sufficient composition and durability such that it substantially does not undergo deterioration in infrared reflectance capability after thermal cycling to 1000° C. for at least 500 hours, preferably, for at least 3000 hours. In certain embodiments, the coating layer is effective to engender a maximum temperature difference between lamp hot spot temperature and lamp cold spot temperature during lamp operation of less than about 200° C., more preferably less than about 100° C., even more preferably less than about 50° C.

In embodiments of the disclosure, the coating layer is formed of a nonmetallic material. Suitable nonmetallic materials include one or more of titanium oxide, tin oxide, tantalum oxide, hafnium oxide, zirconium oxide, aluminum oxide, zinc oxide, magnesium oxide, a lanthanide oxide, barium sulfate, and the like. In embodiments, titanium oxide is utilized as a sole nonmetallic material or in combination with other nonmetallic materials. As used herein, any of the aforementioned oxides (for example, titanium oxide, tin oxide, or any of the oxides named previously) are considered to include compounds of oxygen and the named metal, in any oxidation state. Thus, recitation of "zirconium oxide" (for example) is intended to include zirconium in tetravalent form or in any reduced or partially reduced form, as well as $ZrO_2$, as long as it is in combination with oxygen. In certain exemplified embodiments, rutile form of $TiO_2$ is utilized.

In embodiments of the disclosure, preferred nonmetallic materials that compose the coating layer can be selected on the basis of ability to reflect infrared radiation. In some embodiments, the ability to reflect infrared radiation is defined in terms of the refractive index of the nonmetallic material at an infrared wavelength. Thus, in some embodiments, the coating layer comprises a nonmetallic material having a refractive index of greater than about 1.8 at an infrared wavelength. As used herein, "an infrared wavelength" refers to a wavelength in the range of from about 700 nm to about 2500 nm. Other factors which can be employed to select preferred nonmetallic materials for coatings of the disclosure, are low toxicity, availability, low material cost, and ability to be coated upon a substrate by slurry means. However, the nonmetallic material is not intended to be limited to only those which satisfy any one or more of these criteria.

The nonmetallic material is present on the outer surface of the vessel as an adherent infrared reflective coating layer. It is understood however, that one, or more than one, such coating layer can be present as a laminate, each of which layer can comprise one of the aforementioned nonmetallic materials. Therefore, it is intended that "layer" is defined to include multiple layers where more than one has been applied to the lamp. In embodiments of the disclosure, the coating layer has a thickness of up to about 30 microns. In other embodiments, the coating layer has a thickness of about 5 to about 20 microns. Preferably, the coating layer is a crack-free coating, both as-made and after thermal cycling, in order to retain ability to reflect IR radiation. The coating layer generally comprises particles of said nonmetallic material having a median size greater than about 0.05 microns, typically in the range of from about 0.1 to about 10 microns; and more specifically, the particles of said nonmetallic material can a median size in the range of from about 0.3 to about 1.3 microns. It is also desirable that the coating layer have a coefficient of thermal expansion (CTE) which is a good match with the CTE of the underlying ceramic vessel, that is, the CTE of the coating layer is not so different that thermal stresses are created upon heating of the ceramic vessel and coating layer to lamp operating temperature.

To the outer surface of the vessel can be applied one or more adherent infrared reflective coating layer comprising the nonmetallic material, by any of a wide variety of coating methods, including many conventional methods. In embodiments, the coating layer material can applied in a liquid phase, as for example, a slurry, suspension, or a solution. In other embodiments, the coating layer material can be applied by vapor phase deposition, plasma spray-based deposition, chemical vapor deposition, and the like. When utilized, typical liquid-phase coating techniques include solvent coating, extrusion coating, spray coating, dip coating, slip-casting, brush-painting, rolling, pouring, lamination, solution spin coating, and combinations thereof, and the like. In exemplified embodiments, the coating layer material is applied by the dip coating of a slurry; however, the disclosure is not to be construed as limited thereto, and can encompass any effective method known to the skilled practitioner to apply at least one adherent infrared reflective coating layer comprising a nonmetallic material.

When utilized, typical liquid-phase coating techniques include the coating of the vessel by the nonmetallic material in dissolved or particulate form, in combination with a liquid vehicle. The liquid vehicle can be organic but in some preferred embodiments the vehicle is aqueous for environmental reasons. For example, one general means of preparing a particulate form of the selected nonmetallic material in an aqueous vehicle includes preparing a slurry of the nonmetallic material in water. Generally, a particulate form of the nonmetallic material is combined with water and, if desired, a dispersant material, to form a slurry. The slurry can be comminuted to achieve the desired median particle size of the nonmetallic material, for example, by rack milling for a suitable length of time in the presence of milling media. Other conventional means of preparing a slurry of the nonmetallic material are intended to be within the scope of the disclosure. After its preparation, the slurry can be applied to the appropriate location of the lamp vessel by any of the typical liquid-phase coating techniques described above; subject, of course, to the condition that the coating technique results in a location and a thickness of the coating layer such that the temperature gradients in the vessel during lamp operation are minimized.

After the coating is applied, it is generally subject to a sintering step. In embodiments, the coating layer is subjected to sintering conditions effective to density the layer to a value in the range of from about 60% to about 90% of theoretical density for the nonmetallic material. In another embodiment, the coating layer is subjected to sintering conditions including a temperature in the range of about 600° C. to about 1200° C. for a time of from 1 min to 100 h. Other ranges can be chosen, and an exemplary sintering schedule is shown in the Examples. It is desirable that sintering is conducted such that that the coating layer achieves a CTE which is a good match with the CTE of the underlying ceramic vessel.

Referring now to FIG. 1, here is shown a schematic illustration of a ceramic HID lamp having an adherent IR reflective coating according to illustrative embodiments of the disclosure. As illustrated, a lamp comprises an elongated (in this illustration, cylindrical) discharge vessel 1 having at least one wall 5 which is formed of a light-transmitting ceramic material. Vessel 1 has a central portion 2 enclosing an interior space 4 containing an ionizable dose. Vessel 1 also has two end portions 3 each of which supports a current conductor 8 extending from opposed end closures 7, for supplying current to discharge electrodes 6 within interior space 4. Notably, item 9 represents an adherent infrared reflective coating layer located on the outer surface of the vessel 1. As illustrated, substantially the entirety of end portions 3 are coated, and at least a portion of wall 5 is similarly coated. As the nonmetallic coating materials utilized herein are ordinarily substantially opaque to visible light, the central portion 2 of vessel 1 would not generally be completely coated; however, in many embodiments, coating of portion 2 yields advantages, as described in the detailed disclosure and examples below.

Methods are provided in the present disclosure to enable one to preselect the location and thickness of the coating layer in order to minimize the temperature gradients in the vessel during lamp operation. In order to preselect these parameters for a lamp of arbitrary geometry and properties, the approach is to design an HID lamp having an IR coating according to two design tools, computational and experimental.

An important component of this approach includes the use of a computational model of the thermal aspects of the system, especially a Computation Fluid Dynamic (CFD) model. This kind of computational tool includes solving a plasma fluid dynamic equation (fluid flow and heat transfer) as well as the heat transfer equations associated with the ceramic vessel. The input to the model would include the discharge operating conditions, vessel geometry and properties of the materials of the lamp components. The input to this model would also include the optical and thermal properties of the IR reflective coating, particularly its emissivity and thermal conductivity, as well as the dimension of the coating, particularly, the thickness and surface area of the vessel that is coated. In order to design an IR reflective coating, the model would be exercised by changing the coating parameters and computing the profile of the outer temperature of the vessel. This thermal field is loaded into an ANSYS (Ansys Inc.) stress model to compute the stress field generated in the ceramic vessel from the thermal gradients. The optimal coating parameters would be those that lead to the smallest thermal gradient possible (as close as possible to an isothermal lamp) and therefore to minimum stresses anywhere in the ceramic vessel, preferably stresses less than 100 MPa.

Another important component for determining the preselected location and thickness of the coating layer, is conducting a set of experimental measurements of the discharge vessel thermal profile using an IR camera. This experimental tool measures the IR radiation emitted from the vessel when it is heated to a certain temperature, then (when properly calibrated) the instrument convert the IR radiation measurement into a temperature value. This experimental tool would be used to validate the computed temperature profile by the thermal model.

Taking the computational model in tandem with the experimental sets, one would exercise the model extensively to optimize the coating parameters, and then lamps would be built with coatings having locations and thicknesses suggested by the computational model. The temperature profile would be measured on these lamps to validate the design. If needed, further iterations are performed with the model to refine the coating design parameters.

Yet another component of the approach used to determine preselected values of location and thickness of the coating layer, is the reliability test. This includes building a representative number of lamps (e.g., 50), each having a coating of what are indicated to be an optimal design (i.e., from the computational modeling and the experimental tests), and put them on life-cycling test. According to conventional tests in the automotive industry to assess lamp reliability, lamps are cycled (ON/OFF) under nominal operating conditions. The number of lamp that fail within a certain time (e.g, 1000 h) would be counted and the reliability would be the percent of lamp failed. A typical target for the automotive industry is no more than 3% failure for cycling time at 3000 h. While not a limiting feature of the present disclosure, lamps of the present disclosure are capable of achieving such low failure rates.

The ceramic HID lamp of the present invention is particularly useful in an automotive HID headlamp, and also in video projection lamps, medical lamps, display lighting, fiber-optic illumination, and also other applications where scattered light is undesirable and a well-controlled beam pattern is desired, or in an application where the size or weight or cost of the optical system can be reduced by a reduction in the effective size of the light source. The present disclosure specifically includes the use of the lamp for headlights of a vehicle, such as an automobile, an aircraft, a locomotive, a water craft and other land traversing vehicles as well as for air traffic taxi lights. Although ceramic HID automotive lamps are discussed extensively in this disclosure, the disclosure is applicable to other ceramic HID lamps as well.

EXAMPLES

The examples that follow are merely illustrative, and should not be construed to be any sort of limitation on the scope of the claimed invention.

Example 1

A detailed general experimental procedure used for coating an elongated ceramic HID lamp proximate its first and second end portions, is as follows:

Into a 250 mL polypropylene bottle was weighed 50 g YSZ (yttria-stabilized zirconia, 5 mm media, cylindrical). To this, was added 97 g deionized water, 5 g Darvan C (a polymethacrylate polyelectrolyte dispersant, trademark of R.T. Vanderbilt Co., Norwalk, Conn., USA), and 2 g of PEG 400 in sequences. Then 35 g of $TiO_2$ (Ranbaxy, 98%, rutile form) was added to the above mixture. The resultant mixture was rack milled for 25 h to produce a slurry. A requisite amount of slurry was then transferred into a narrow glass vial so that the height of the slurry is adequate enough to cover a desired coating length on a lamp. A portion of a lamp leg to be coated was dipped into the slurry and then lifted out. Excess slurry was removed by holding the lamp in a vertical position. These steps of dip slurry coating and excess removal were repeated for a second lamp leg.

After suspending the lamp vertically, it was dried in a closed container for 5 h. Although timing and condition of drying could differ depending upon ambient condition like temperature and humidity, in this embodiment, closed box drying worked to slow down the drying and avoid cracks. For sintering, the coated lamp was suspended in an alumina boat and placed in a tube furnace using an atmosphere of ultra-high purity Ar. An exemplary sintering cycle included ramping the coated lamp from room temperature at a rate of 3° C./min until 600° C., at which temperature it was held for 0.5 h. Following this, temperature was ramped up again at a rate of 3° C./min to 1000° C., at which it was held for 10 h, followed by a 3° C./min cool-down back to room temperature. By following this general experimental procedure, lamps having coatings of various thicknesses were provided, depending upon the precise procedure used for the dip coating step.

Example 2

In this Example, YAG disks were utilized as model lamp envelope materials. In general, a procedure analogous to that of Example 1 was followed for coating these disks with titania. In particular for this example, the particle size distribution is shown in Table 1 below:

TABLE 1

| Particle Size Distribution of rutile $TiO_2$ utilized | |
|---|---|
| Specific area (in $cm^2$/mL powder) | 61926 |
| Median particle size (in microns) | 1.083 |
| Mean particle size (in microns) | 1.2801 |
| Standard deviation of particle size (in microns) | 0.7225 |

Figure 2:
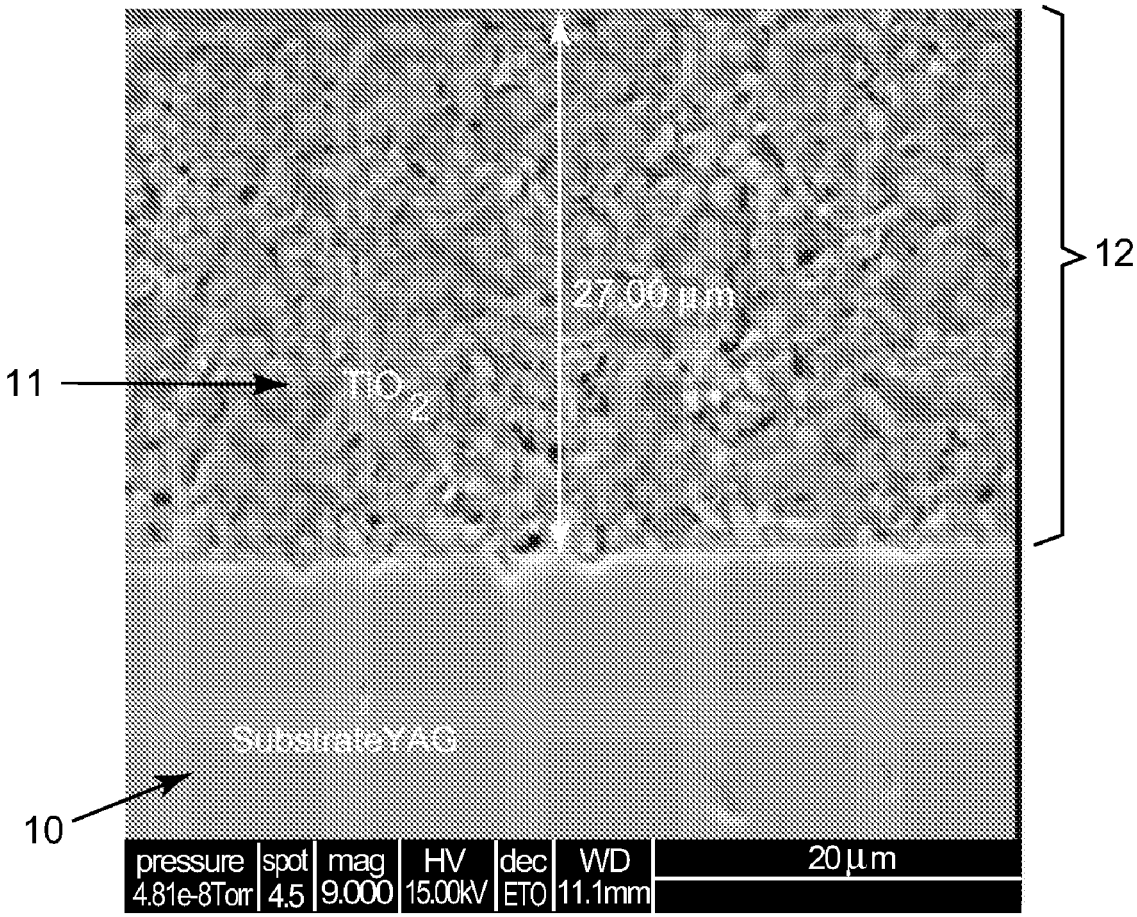
FIG. 2 is a cross-sectional SEM image of titania coated on a representative ceramic substrate.

The median particle size of the powder used was approximately 1 micron, and the range was 0.3 to 1.3 microns. Aqueous slurries of this powder were prepared as in Example 1, but the slurry preparation conditions for crack free coatings were optimized by varying solids loading ($TiO_2$ vol %) and suspension pH. An optimum slurry for providing crack-free coatings was found to be pH of about 9, solid loading at 9 vol % and milling for 24 h. In general, coating thickness on the YAG disk could be varied by the number of dipping cycles. FIG. 2 shows the scanning electron microscope (SEM) image of an unsintered titania coating 11 on a YAG disk substrate 10. In this model coating, the thickness 12 is 27 microns.

Figure 3:
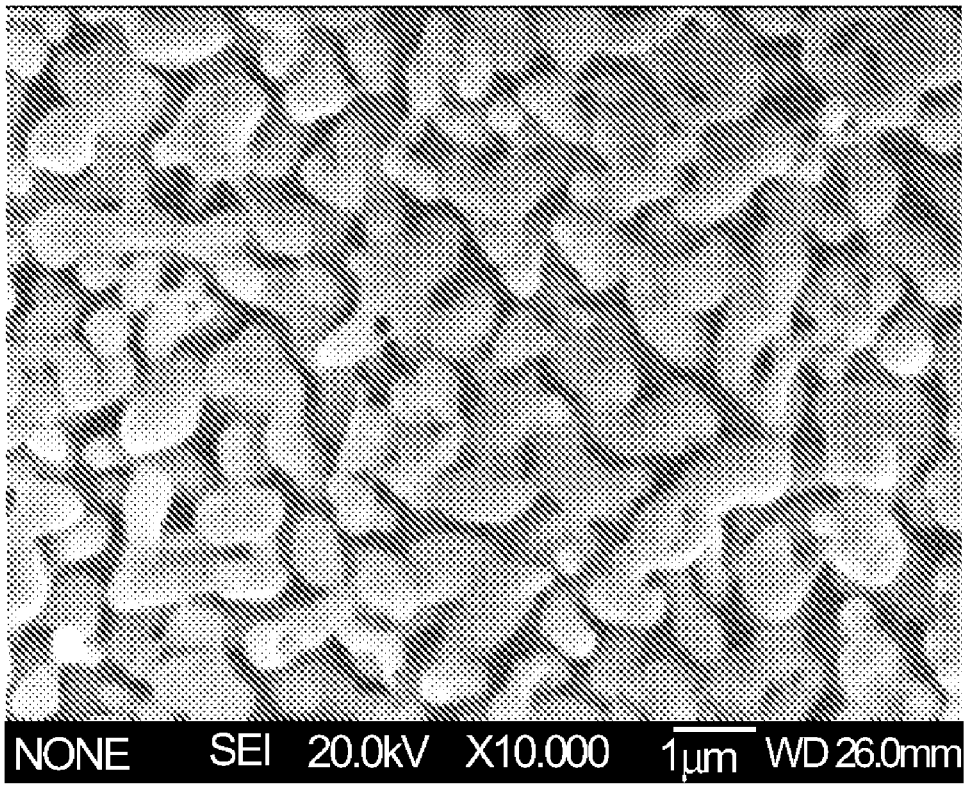
FIG. 3 is an SEM image of a sintered titania coating according to illustrative embodiments of the disclosure.

Uniform crack-free coatings using the optimum slurry were made on the YAG disks, to study the IR reflectance variation with respect to bare disk, and the coating thickness. Visual and optical inspection of these did not show any crack formation during drying or sintering. FIG. 3 shows the SEM image of the dried and sintered titania coating, revealing its uniform porosity formed by the sintering of the powder particles.

IR reflectance for these coated YAG disks was studied with respect to bare YAG disk, as a function of the coating thickness. Thickness was measured using a profilometer. Optical reflection of the coatings in the visible and IR regions was measured by using UV-NIR spectrophotometer, in the wavelength range of 500 to 2500 nm. Reflectance of the bare disk is approximately 20%. Upon coating with 5 microns of $TiO_2$, reflectance increased to 85%. However, as the coating thickness increased above 5 microns, reflectance increased, but only marginally. For example, a disk coated with 38 micron thick coating showed 90% reflectance.

Example 3

One of the requirements a coating according to the present disclosure must meet is to survive the thermal cycling that happens during the lamp operations during start up and shut off. To simulate this, the coated YAG disks prepared in Example 2 were tested in a laboratory furnace at different temperatures. Thermal cycling tests were carried out at 1000° C. for periods of 30 min, 1 h, 2 h, and 500 h. In some cases, YAG disks with titania coatings above 20 micron thickness cracked and peeled off upon thermal cycling. Coating adherence after thermal cycling deteriorated further as the coating thickness went above 30 micron. It was found that the optimum coating thickness for good adhesion and reflectance is from about 5 to about 20 micron. After about 500 h of thermal cycling at 1000° C., reflectance of coatings within this range of layer thickness did not undergo deterioration.

Example 4

Figure 4:
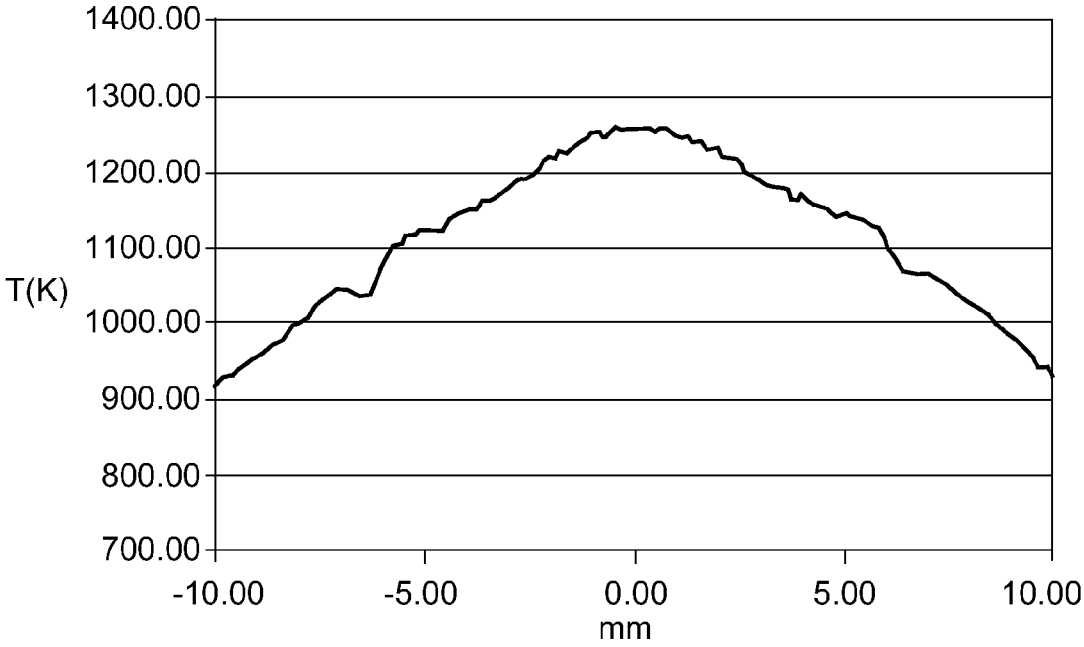
FIG. 4 shows a thermal profile of a bare ceramic HID lamp.
Figure 5:
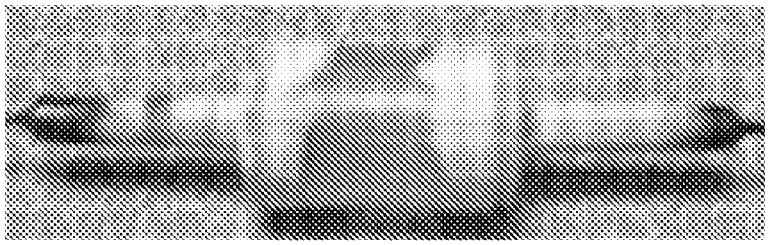
FIG. 5 represents exemplary and control PCA HID lamps.
Figure 5:
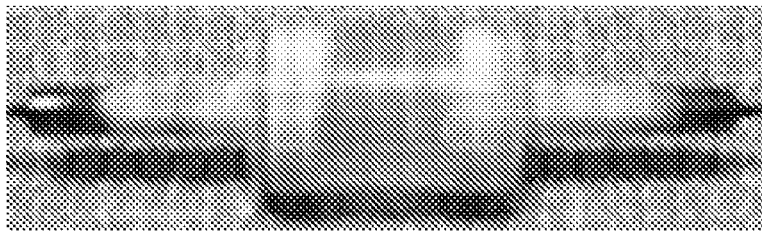
Figure 5:
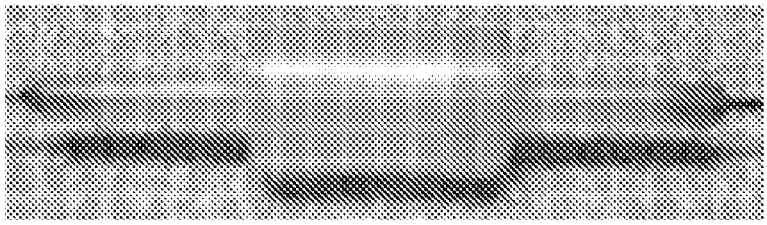

Elongated ceramic HID lamps were coated proximate their first and second end portions using the procedure of Example 1, but using the slurry recipe described in Example 2. Coatings were applied to assembled lamps in this Example, to avoid contamination of the coating inside the lamp body. Thermal profiles of these lamps were measured with the Inframetrix Model 760 IR camera with built in 10.6 micron filter. The camera was positioned at 35 cm from the test lamp. An emissivity coefficient of 0.99 (previously measured for YAG and PCA at the measurement wavelength) was used, and the camera was calibrated with a Micron M335 black body calibration source before the lamp temperature measurements. A typical thermal profile of a bare CMH lamp exhibits a gradient of decreasing temperature as viewed from center to ends. This is seen in FIG. 4, wherein the abscissa of "0.00 mm" denotes the position of the lamp at the center of the arc, and positions are shown to 10.00 mm to the left and right of the arc center. The thermal profiles of lamps were studied in two different coating configurations. Typical leg- and body-coated lamp PCA ceramic metal halide lamps are shown in the photographs of FIG. 5. Note that when a CMH lamp is held in horizontal position, the portion of the vessel closest to the bend of the arc is referred to as "top" and is usually the hottest region of the vessel; and that portion of the vessel which is furthest from the arc is referred to as "bottom". A set of 70 W CMH lamps coated only on legs exhibited an improvement (i.e., increase) in temperature profile when viewed at top, although this was less pronounced when viewed at bottom of discharge vessel. However, this improvement was even more pronounced for lamps coated on both leg and body, since maximum temperatures at top were about 100° C. higher then the control lamp temperature, and the increase was almost uniform through out the length of the lamp. Table 2 below summarizes the temperatures observed at the central portion of the discharge vessel when viewed at the top of the arc:

TABLE 2

| Sample | Top Temp in K at Left 5.00 mm | Top Temp in K at Center of Arc | Top Temp in K at Right 5.00 mm | Delta $T_{max}$ (K) |
|---|---|---|---|---|
| Lamp A | 1220 | 1305 | 1250 | 85 |
| Lamp B | 1210 | 1280 | 1190 | 90 |
| Lamp C (control, uncoated) | 1100 | 1200 | 1130 | 100 |

In Table 2, each of lamps A and B shown in FIG. 5 are body- and leg-coated, and it was observed that the maximum temperature gradient between temperatures of vessel at the center position of the arc and temperatures at positions shifted 5.00 mm on each side, was decreased relative to control (uncoated) lamp C. In each case, the axial length of the central portion of the vessel (i.e., within which gas discharge occurs) was approximately 13.6 mm, with a diameter of approximately 8.6 mm. The leg portions were each about 12 mm in length and had a diameter of about 2.8 mm.

Various embodiments of this invention have been described in rather full detail. This written description uses examples to disclose embodiments of the invention, including the best mode, and also to enable a person of ordinary skill in the art to make and use embodiments of the invention. It is understood that the patentable scope of embodiments of the invention is defined by the claims, and can include additional components occurring to those skilled in the art. Such other arrangements are understood to be within the scope of the claims.

What is claimed is:

1. A high intensity gas discharge lamp, said lamp comprising:

an elongated light-emitting discharge vessel having a wall formed of a ceramic material, said vessel having central portion enclosing an interior space, and first and second end portions;

an ionizable dose within said interior space;

first and second discharge electrodes positioned within the vessel proximate said first end portion and said second end portion, respectively;

wherein said lamp further comprises at least one adherent infrared reflective coating layer located on the outer surface of the vessel proximate the first and second end portions, said coating layer comprising a nonmetallic material, said nonmetallic material selected from the group consisting of titanium oxide, tin oxide, hafnium oxide, aluminum oxide, zinc oxide, magnesium oxide, a lanthanide oxide, barium sulfate, and mixtures thereof;

wherein said coating layer substantially does not undergo deterioration in infrared reflectance capability after thermal cycling to 1000° C. for at least 500 hours.

2. The lamp of claim 1 wherein said nonmetallic material comprises titanium oxide.

3. The lamp of claim 1 wherein the coating layer has a thickness of about 5 to about 20 microns.

4. The lamp of claim 1 wherein the coating layer comprises particles of said nonmetallic material having a median size in the range of from about 0.1 to about 10 microns.

5. The lamp of claim 1 wherein said first and second electrodes are positioned so as to energize said dose when electric current is applied thereto.

6. The lamp of claim 1 wherein the coating layer is additionally on at least a portion of the outer surface of the central portion.

7. The lamp of claim 1 wherein a temperature difference between a lamp hot spot temperature and a lamp cold spot temperature during lamp operation is about 200° C. or less.

8. The lamp of claim 1 wherein the ionizable dose comprises at least one selected from the group consisting of noble gas, halogen, rare earth element, mercury, thallium, indium, alkali metal element, and combinations and compounds thereof.

9. The lamp of claim 1 wherein the ceramic material comprises one or more of polycrystalline alumina or yttrium aluminum garnet.

10. The lamp of claim 1 wherein the coating layer has a density about 60% to about 90% of theoretical density for the nonmetallic material.

11. The lamp of claim 1 wherein said coating layer comprising a nonmetallic material having a refractive index of greater than about 1.8 at an infrared wavelength.

12. A high intensity gas discharge lamp, said lamp comprising:

an elongated light-emitting discharge vessel having a wall formed of a ceramic material, said vessel having central portion enclosing an interior space, and first and second end portions;

an ionizable dose within said interior space;

first and second discharge electrodes positioned within the vessel proximate said first end portion and said second end portion, respectively;

wherein said lamp further comprises at least one adherent infrared reflective coating layer located on the outer surface of the vessel proximate the first and second end portions, said coating layer comprising a nonmetallic material having a refractive index of greater than about 1.8 at an infrared wavelength;

wherein a location and a thickness of said coating layer are each preselected to provide a temperature difference of about 100° C. or less between lamp hot spot temperature and lamp cold spot temperature in said elongated light-emitting discharge vessel during lamp operation.

13. The lamp according to claim 12, wherein said nonmetallic material is selected from the group consisting of titanium oxide, tin oxide, hafnium oxide, aluminum oxide, zinc oxide, magnesium oxide, a lanthanide oxide, barium sulfate, and mixtures thereof.

14. The lamp according to claim 12, wherein said coating layer has a density of about 60% to about 90% of theoretical density for the nonmetallic material.

15. The lamp according to claim 12, wherein said coating layer substantially does not undergo deterioration in infrared reflectance capability after thermal cycling to lamp operating temperature for the life of the lamp.

16. The lamp according to claim 12, wherein the coating layer has a thickness of about 5 to about 20 microns.

17. A high intensity gas discharge lamp, said lamp comprising:

an elongated light-emitting discharge vessel having a wall formed of a ceramic material, said vessel having central portion enclosing an interior space, and first and second end portions;

an ionizable dose within said interior space;

first and second discharge electrodes positioned within the vessel proximate said first end portion and said second end portion, respectively;

wherein said lamp further comprises at least one adherent infrared reflective coating layer located on the outer surface of the vessel proximate the first and second end portions, said coating layer comprising a nonmetallic material selected from the group consisting of titanium oxide, tin oxide, tantalum oxide, hafnium oxide, zirconium oxide, aluminum oxide, zinc oxide, magnesium oxide, a lanthanide oxide, barium sulfate, and mixtures thereof;

wherein substantially the entirety of the first and second end portions are coated with said coating layer.

18. The lamp according to claim 17, wherein said coating layer substantially does not undergo deterioration in infrared reflectance capability after thermal cycling to 1000° C. for at least 500 hours.

19. The lamp according to claim 17, wherein said coating layer substantially does not undergo deterioration in infrared reflectance capability after thermal cycling to lamp operating temperature for the life of the lamp.

20. The lamp according to claim 17, wherein the ceramic material comprises polycrystalline alumina, yttrium-aluminum garnet, yttria, spinel, aluminum oxynitride, aluminum nitride, or sapphire.

21. The lamp according to claim 17, wherein the coating layer has a thickness of up to about 30 microns.

* * * * *